US005951047A

United States Patent [19]

Dungan

[11] Patent Number: 5,951,047

[45] Date of Patent: Sep. 14, 1999

[54] LOCKING AND CARRYING SYSTEM FOR SKI EQUIPMENT

[76] Inventor: D. Patrick Dungan, 4800 Hale Pkwy., Denver, Colo. 80220

[21] Appl. No.: 08/775,949

[22] Filed: Jan. 3, 1997

[51] Int. Cl.[6] ..... A63C 11/00

[52] U.S. Cl. ..... 280/814; 280/809; 294/147; 70/49

[58] Field of Search ..... 280/814, 816, 280/809, 815; 70/14, 19, 30, 49, 57, 58; 294/147

[56] References Cited

U.S. PATENT DOCUMENTS

| | | | |
|---|---|---|---|
| 3,435,642 | 4/1969 | Del Pesco | 70/49 |
| 3,756,420 | 9/1973 | Brown | 211/60 |
| 3,765,197 | 10/1973 | Foote | 70/58 |
| 3,899,904 | 8/1975 | Brimhall, II | 70/58 |
| 3,976,234 | 8/1976 | Moudry et al. | 224/45 |
| 4,031,720 | 6/1977 | Avaiusini | 70/58 |
| 5,289,704 | 3/1994 | Johnson | 70/30 |

OTHER PUBLICATIONS

Middlesex News, "Lock Down" Reprint (undated).

*Primary Examiner*—Paul N. Dickson
*Assistant Examiner*—Lynda Jasmin
*Attorney, Agent, or Firm*—Kyle W. Rost

[57] ABSTRACT

A cable lock is incorporated into the grip of a ski pole, using the base of the grip as a lock housing. Each ski carries an engaging member that can be fastened into the lock housing to attach each pole to a ski, such as for theft prevention, storage or carrying. In addition, the cable lock wraps the poles and skis and can attach them to a fixed object. The lock housing covers the mounting of the engaging member to the ski, which prevents tampering while the skis and poles are locked.

13 Claims, 3 Drawing Sheets

LOCKING AND CARRYING SYSTEM FOR SKI EQUIPMENT

TECHNICAL FIELD

The invention generally relates to land vehicles and to a ski appliance or attachment. More specifically, the invention discloses a ski pole having means to interconnect with another pole, especially at the handgrip. In a related aspect, the invention discloses a clamp or tie for carrying or storage of skis. In another general aspect, the invention relates to handling hand and hoist-line implements, such as by an article carrier gripped and carried by hand, and having plural diverse receivers, including a receiver or support for a ski. Finally, the invention relates to a package or article carrier, such as a ski carrier.

BACKGROUND ART

Two of the most difficult and persistent problems faced by recreational skiers are transporting and protecting ski equipment. Loose skis and poles are notoriously difficult to hand-carry, such as from a car to the ski base area or ski lift. As a result, mechanical clamps and carriers of many descriptions have been devised to ease the problem, enabling the skis and poles to be carried in a single package. However, the mechanical carrier creates another problem, which is what to do with the carrier while skiing. The solution to this problem is either to leave the carrier at the base area, such as in a locker, or bring along the carrier for the day's skiing. The former is inconvenient, since the carrier is not available during the day when the skier may be at other base areas of the same mountain. The latter is a needless burden, since the skier is engaged in an athletic sport and is likely to want freedom from equipment in excess of what the sport already requires. As a result, many skiers do not use a carrier, instead choosing to tote their equipment in loose condition, perhaps balanced on a shoulder.

Because skis and poles are cumbersome, ski equipment is not allowed inside many buildings, such as restaurants, at a ski area. Typically, while in a restaurant, the skier leaves the equipment outside, leaning against a building or rack in unguarded condition. Many skiers worry that the expensive ski equipment could be taken. While ski locks are common, the skier faces the same problem as with a carrier: hauling extra equipment is a burden and even can be a hazard. For example, a cable lock might be carried around the skier's waist during the day's activity, but the cable can snag on ski lifts, and any bulky part of the lock can injure the skier if he should fall on it. Further, cable locks do a poor job of protecting ski poles. Many skiers simply trust to luck that no one will take their equipment while it is unattended.

The prior art shows many examples of ski carriers and locks. For example, U.S. Pat. No. 3,976,234 to Moudry et al, which discloses a pair of carriers that strap together the skis and clip to the poles. U.S. Pat. No. 3,756,420 to Brown shows a ski carrier that mounts to a car roof. Portions may be detached from the car to enable use with a back pack. U.S. Pat. No. 5,289,704 to Johnson discloses a cable lock that is stored inside a ski pole when not in use. A device known as the Pole Lock is sold by the Wonga Group of Boston, Mass., and is a clip that attaches to ski poles and allows a cable lock to secure the poles.

It would be desirable to have a unified system for carrying and locking ski equipment. It would be especially desirable to have such a system integrated into the normal skis and poles, such that the skier has substantially no extra apparatus to leave at the base area or carry as an added burden during the day of skiing. Further, it would be desirable to have a carrying and locking system that is easily and readily used in either mode.

To achieve the foregoing and other objects and in accordance with the purpose of the present invention, as embodied and broadly described herein, the apparatus of this invention may comprise the following.

DISCLOSURE OF INVENTION

Against the described background, it is therefore a general object of the invention to provide an improved carrying and locking system for ski equipment.

Another object is to provide a carrying and locking system in which the system is built into the skis and poles, such that it is inherently available for use when the skis and poles are present.

Additional objects, advantages and novel features of the invention shall be set forth in part in the description that follows, and in part will become apparent to those skilled in the art upon examination of the following or may be learned by the practice of the invention. The object and the advantages of the invention may be realized and attained by means of the instrumentalities and in combinations particularly pointed out in the appended claims.

According to the invention, a locking and carrying system for ski equipment is provided with a lock housing that is joined to a flexible shackle. A free end of the shackle selectively engages or disengages the lock housing. Any suitable device may mount the lock housing on a ski pole, although ski pole grips are the preferred mounting device. An engaging member selectively engages or disengages the lock housing in order to attach or detach the lock housing to skis. A suitable mounting device may attach the engaging member to a ski, with a mounting plate being preferred. The lock housing carries a lock that is selectively operable between locked and unlocked configurations. The lock secures both the shackle and the engaging member to the lock housing when in locked configuration. In addition, the lock housing covers the mounting plate when the engaging member is locked into the lock housing.

The accompanying drawings, which are incorporated in and form a part of the specification illustrate preferred embodiments of the present invention, and together with the description, serve to explain the principles of the invention. In the drawings:

BEST MODE FOR CARRYING OUT THE INVENTION

The invention is a locking and carrying system for ski equipment, such a skis and ski poles. The elements of the system are integrated into the structure of the ski equipment or can be affixed to existing ski equipment. When the skier is not using the equipment or is transporting it, the elements needed to lock together the poles and skis are present as a unified part of the equipment. Any portions of the system that are not affixed to the poles or skis are insubstantial in nature, such as a key for the lock mechanism or a tip strap for poles. Thus, the usual problem of how to carry or store a cable lock or independent carrier is solved.

Figure 1:
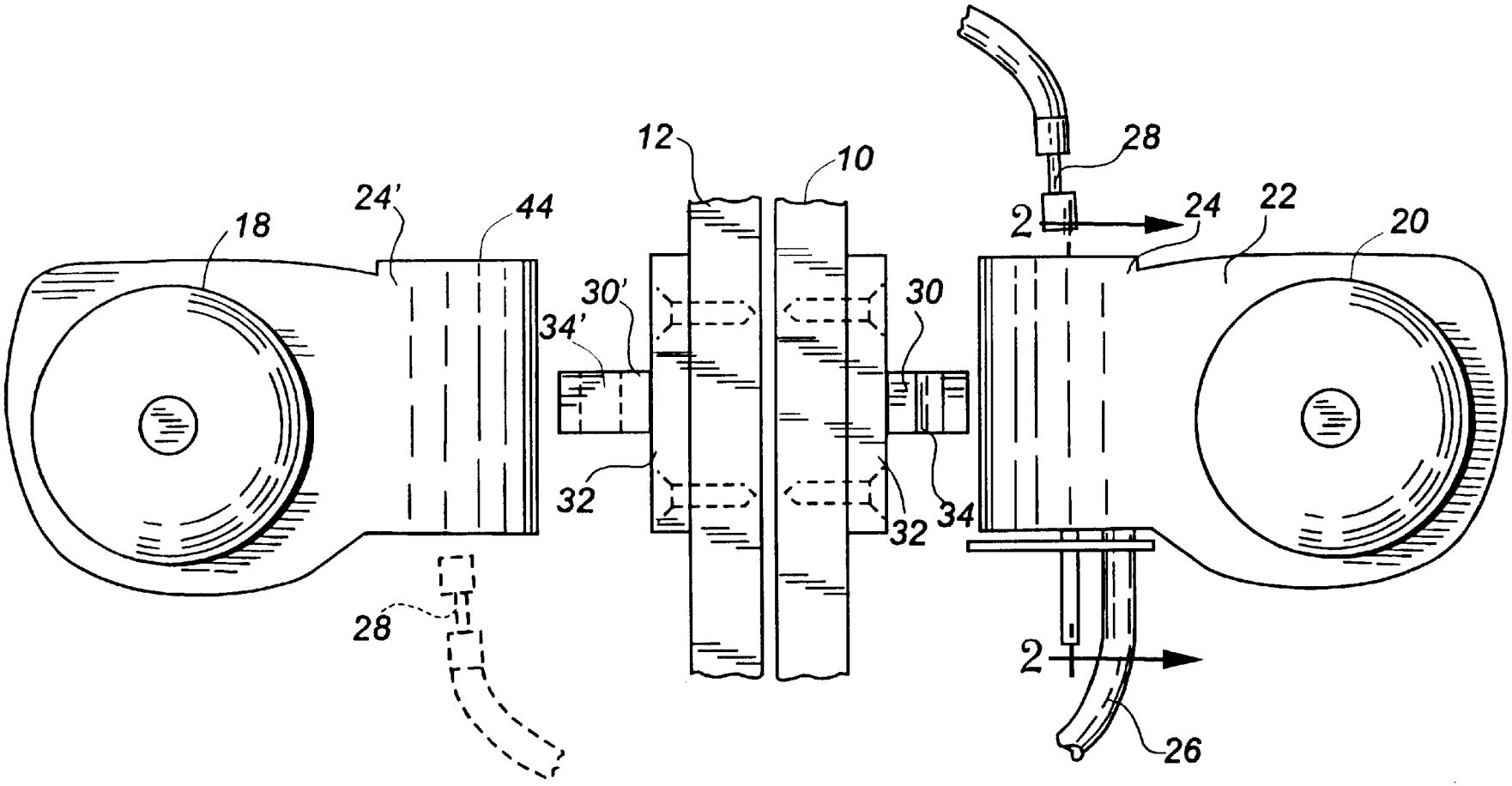
FIG. 1 is an exploded, cross-sectional view taken transversely to a pair of skis and poles being locked with the invention.
Figure 3:
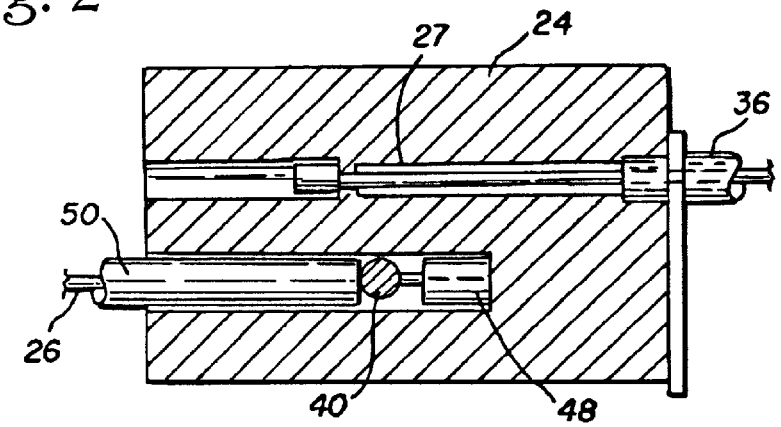
FIG. 3 is a cross-sectional view taken along the plane 3—3 of FIG. 2, showing another view of the locking mechanism within the first grip.
Figure 6:
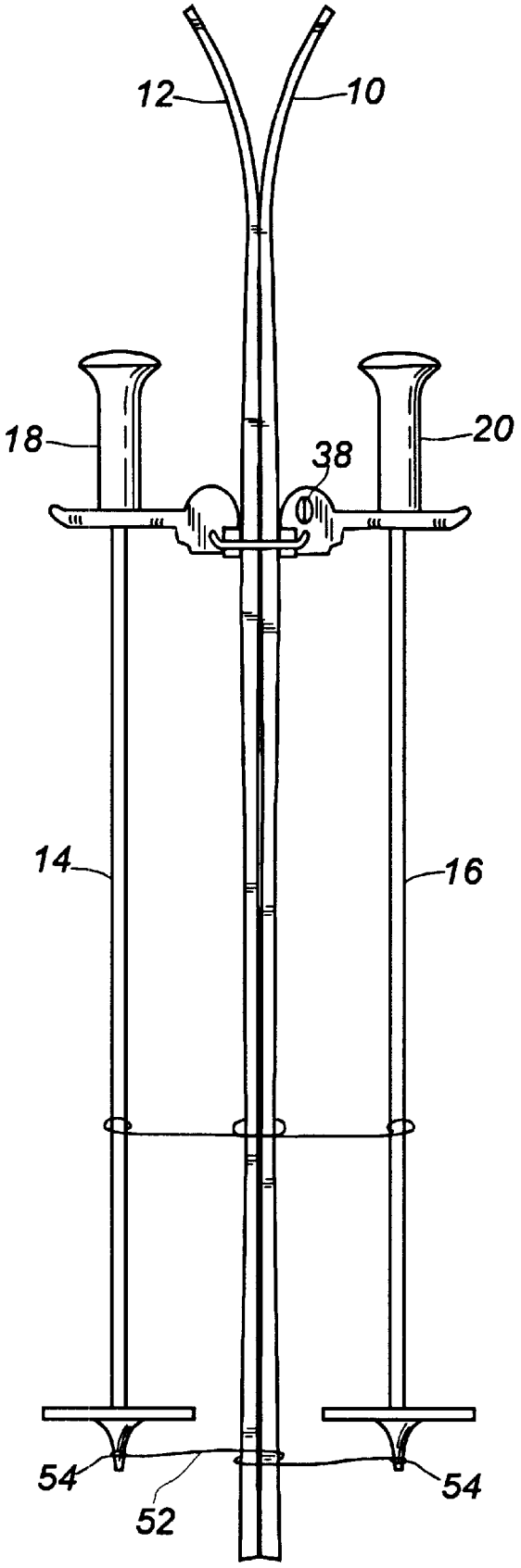
FIG. 6 is an elevational view of a pair or skis and poles locked together in carrying configuration, with a supplemental tie on the pole tips.

With initial reference to FIG. 6, the system creates a package consisting of two skis 10, 12 and two poles 14, 16, secured in a single unit. The skis 10, 12 are substantially identical and are interchangeable from the perspective of the system. However, the poles 14, 16 carry distinctly different equipment, with pole 16 carrying a lock mechanism. More specifically, the ski pole grips 18, 20 serve as vehicles to carry the lock, although the lock could be mounted separately to the pole, if desired. The grips are preferred carriers because they provide a wide mounting point that enables the poles and skis to be assembled in a substantially parallel configuration. In FIG. 1, grip 20 is shown as a unitary structure having a wide bottom flange 22 that carries a lock housing 24 extending beyond the portion of the flange necessary for comfortable hand engagement. The lock housing 24 is joined to an end of a flexible shackle 26, such as a steel cable. The fixed end of the cable is attached to the lock housing by any suitable means, such as press fit, weld, or mechanical block 27 as shown in FIG. 3. The opposite end of the cable is a free end 28, which selectively engages or disengages the lock housing. On the right side of FIG. 1, this free end is shown aligned for insertion into a bore of the lock housing. On the left side of FIG. 1, in phantom, free end 28 is shown aligned for passage through a bore of a corresponding receptor housing 24' in grip 18. The grips 18 and 20 serve as a preferred means for mounting the lock housing on a ski pole, although other types of clamps or mountings could support the lock housings equally well.

Figure 5:
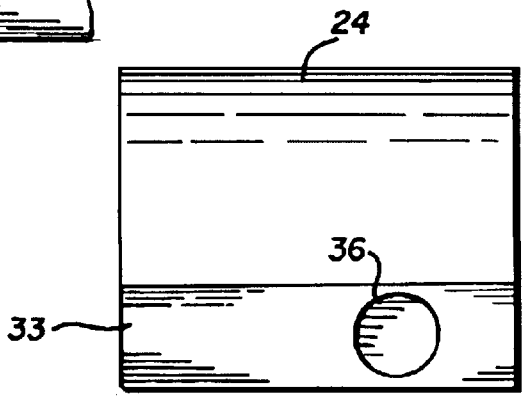
FIG. 5 is a side elevational view of the first grip, showing the mounting channel and pin-receiving chamber

While the cable 26 locks together the two poles by their handle grips, the locking system also engages the skis. For this purpose, an engaging member associated with ski 10 selectively engages and disengages the lock housing 24, while a second engaging member associated with ski 12 selectively engages and disengages the receptor housing 24'. The engaging members on each ski may be similar or substantially identical and provide a post 30, 30' having a transverse cable reception site such as a bore, groove, or other structure 34, 34' that can be locked in place by the cable. The post and bore or other structure associated with ski 10 will be referred to as post 30 and reception site structure 34, while the corresponding post and reception site structure of ski 12 will be referred to as 30' and 34', respectively. The lock housing defines a bore 36, shown in FIGS. 2 and 5, that receives the post 30 in a position placing the bore 34 in alignment with the cable. Grip 18 has a bore in the receptor housing 24' similar to bore 36 for receiving the post 30' of ski 12.

The posts 30, 30' are attached to the top face of a ski by use of a mounting means such as a plate 32 and any suitable attachment devices, such as screws or studs. The lock housing 24 and receptor housing 24' each are provided with a groove 33, shown in FIG. 5, that fits over the mounting plate when post 30 or 30' is fully engaged in the respective housing, covering the mounting plate and screw heads. The groove prevents the ski from being twisted with respect to the housing 24 or 24' while the post 30, 30' is engaged in the housing. Because the mounting plate and screws are covered by the grip, the plate cannot be removed to defeat the lock. Twisting the grips 18, 20 with respect to the engaging members would be destructive to the skis, the grips, or both. The engagement among the shackle 26, the housings 24, 24', and the posts 30, 30' also prevents relative twisting between the skis and poles. Thus, when the package of skis and poles is locked together, the package is highly resistant to tampering.

Figure 2:
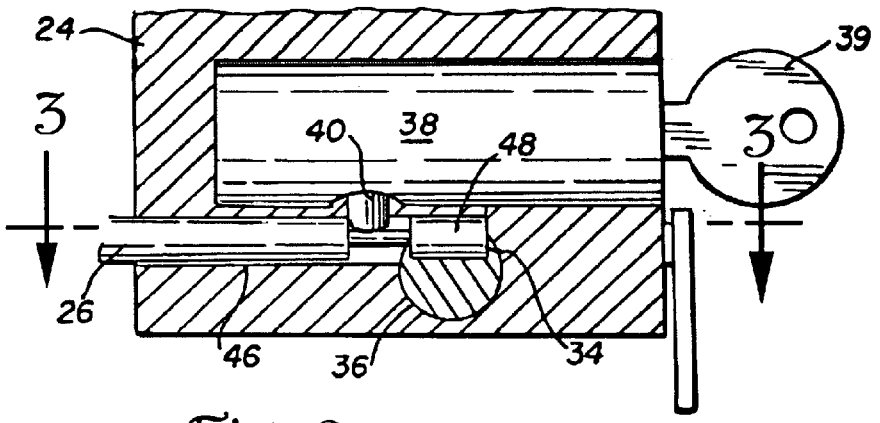
FIG. 2 is a cross-sectional view taken along the plane 2—2 of FIG. 1, showing the locking mechanism within a first grip.

With reference to FIG. 2, the lock housing carries a means for locking the cable 26 and post 30 within the housing. A tumbler lock 38 is suitable and can be operated by key 39 or combination. The preferred lock employs a lock pin 40 that is selectively operable between extended, locked configuration and retracted, unlocked configuration.

The lock housing 24 defines a network of bores and chambers that accommodate the lock 38, the cable 26, the post 30, and the lock pin 40. A shackle bore 46 may extend into the lock housing from a rear face of the housing 24, while the fixed end of the cable 26 may extend from the front face of the housing 24. In the mating grip 18 having receptor housing 24', a through-bore 44 in the receptor housing 24' allows passage of the free end of the shackle or cable. The post bores 36 are formed in respective housings 24, 24', in a position at least partially intersecting the respective shackle bores 44 and 46.

Figure 4:
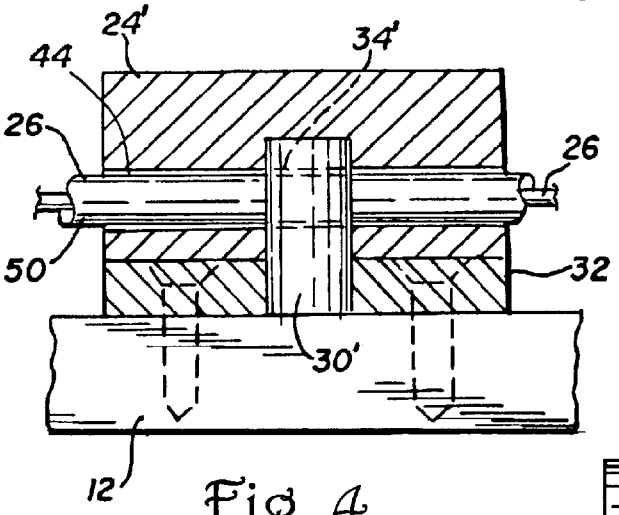
FIG. 4 is an assembled cross-sectional view taken through the second grip and showing the locking mechanism engaged with the second grip.

In the preferred structure of grip 18, shown in FIG. 4, the reception site 34' of post 30' has a through-bore and the post bore 36 intersects through-bore 44 of housing 24' on its center line. Bore 34' is aligned with shackle bore 44, and the cable passes through both, positively locking grip 18 to ski 12. Thus, post 30' serves as a second engaging member that selectively engages and disengages the receptor housing 24'. The bore 34' defined through post 30' serves as a means for securing the second engaging member to the flexible shackle 26. In addition, the post 30' also is a means for retaining the second engaging member in engagement with the receptor housing 24'.

In the preferred structure of grip 20, the post bore 36 intersects shackle bore 46 but is offset in order to provide a clearance from lock 38. The reception site structure 34 traversing the post 30 on ski 10 may be a semi-circular groove instead of a full bore. The shackle shares a portion of the post bore 36 and a portion of the shackle bore 46, locking the post 30 in post bore 36. The lock pin 40 is positioned closer to the rear facing entrance of shackle bore 46 and, when in extended position, enters at least a portion of the shackle bore. The shackle cable 26 is of preselected diameter and carries on its free end an end knob 48 of relatively larger diameter. When the end knob 48 has passed to the end of bore 46 as shown in FIGS. 2 and 3, the end knob is engaged in the intersection of bores 46 and 36. In this position, when the post 30 is inserted in bore 36, the end knob engages groove 34 and locks the post in the lock housing.

The shackle bores 44 and 46 are sized to receive the end knob 48. The cable 26 is smaller in diameter than the end knob, but the cable is preferred to have an anti-abrasive covering such as a vinyl sleeve 50 that may be of similar diameter to the end knob. The protective sleeve 50 terminates in advance of the end knob 48, leaving a short distance of uncovered cable juxtaposed to the end knob. As shown in FIGS. 2 and 3, when the lock pin 40 is extended, it approaches the fully inserted cable at this uncovered length, creating a positive lock behind the end knob. Thus, the intersection of the shackle bore 46 with bore 36 is past the entry point of the lock pin 40 into the shackle bore. The end knob portion of the shackle partially resides in bore 36 when the shackle is locked in the shackle bore 46.

Although the reception site structure of post 30 may be a groove while reception site 34' may be a bore, both structures define a reception site of complimentary shape to the portion of the shackle that will be engaged. Site 34 also may be a bore if the lock pin 40 is extendable far enough to allow bore 36 to intersect the center line of bore 46.

In operation, the lock and carrier is used by inserting posts 30, 30' in their respective post bores 36. Next, the shackle or cable 26 is inserted entirely through shackle bore 44 in body 24'. The shackle is further and fully inserted into the shackle bore 46 of lock housing 24. By turning key 39, the lock pin 40 is extended behind end knob 48, which prevents the shackle from being removed from the shackle bore 46. In this configuration, each pole is locked to a ski, the skis are held together in the loop of the shackle, and the poles also are locked in the loop. The skis and poles define a secure package that discourages theft. The shackle may be looped around a fixed structure, as well, to prevent the equipment package from being removed.

The package is disassembled by turning key 39 to retract the lock pin. The free end of the shackle is withdrawn from bores 46 and 44, which allows each pole to be removed from its attachment to a ski. The shackle can be stored by looping it around pole 16, reinserting its free end into the bore 46 and locking it in place. The external length of the shackle is about ten inches, which prevents it from being a nuisance.

The skis and poles are handled identically for carrying. Optionally, the tips of the poles can be engaged by a tie 52 having with looped ends 54, as shown in FIG. 6. The shank of the tie can be wrapped around the skis to improve the stability of the package for carrying. A suitable tie is a length of cable about 13 inches long including the looped ends.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

I claim:

1. A locking and carrying system for ski equipment, comprising a lock housing joined to a flexible shackle having a free end that selectively engages or disengages the lock housing;

a handgrip mountable on a ski pole and unitary with said lock housing;

engaging member that selectively engages and disengages the lock housing;

means for mounting the engaging member on a ski;

a lock means carried by the lock housing, selectively operable between locked and unlocked configurations, for securing the shackle and engaging member to the lock housing when in locked configuration; and wherein, the lock housing covers the means for mounting the engaging member on a ski, when the engaging member engages the lock housing.

2. The system of claim 1, wherein:

said lock housing defines a shackle bore and an engaging member bore in at least partially intersecting positions; and said lock means comprises a selectively retractable and extendable lock pin, wherein when the lock pin is extended, the lock pin transversely enters at least a portion of the shackle bore.

3. The system of claim 2, wherein:

said flexible shackle is of preselected diameter and carries on its free end an end knob of relatively larger diameter; and said shackle bore and end knob are relatively sized such that the end knob is insertable into the bore past the entry point of the lock pin, whereby the lock pin locks the shackle into the bore by securing the end knob.

4. The system of claim 3, wherein:

said intersection of the shackle bore and engaging member bore is past the entry point of the lock pin, whereby a portion of the end knob resides in the engaging member bore when the shackle is locked in the shackle bore.

5. The system of claim 4, wherein said engaging member defines a reception site of complimentary shape to said portion of the end knob in the engaging member bore, receiving the end knob in the reception site and locking the engaging member in the engaging member bore.

6. The system of claim 1, further comprising:

a receptor housing having a through-bore sized to pass the free end of said flexible shackle;

means for mounting the receptor housing on a ski pole; and a second engaging member that selectively engages and disengages the receptor housing and defines a means for securing the second engaging member to the flexible shackle.

7. The system of claim 6, wherein:

said means for securing the second engaging member to the flexible shackle also comprises a means for retaining the second engaging member in engagement with the receptor housing.

8. The system of claim 7, further comprising:

means for mounting the second engaging member on a ski, wherein the receptor housing covers the means for mounting the second engaging member on a ski when the second engaging member engages the receptor housing.

9. The system of claim 6, wherein:

said means for securing the second engaging member to the flexible shackle comprises a bore defined in second engaging member and alignable with the through-bore when the second engaging member engages the receptor housing.

10. The system of claim 6, wherein said means for mounting the receptor housing on a ski pole comprises a hand grip.

11. A locking and carrying system for ski equipment, comprising a lock housing joined to a flexible shackle having a free end that selectively engages or disengages the lock housing;

means for mounting the lock housing on a ski pole;

an engaging member that selectively engages and disengages the lock housing;

means for mounting the engaging member on a ski;

a lock means carried by the lock housing, selectively operable between locked and unlocked configurations, for securing the shackle and engaging member to the lock housing when in locked configuration, wherein, the lock housing covers the means for mounting the engaging member on a ski, when the engaging member engages the lock housing;

a receptor housing having a through-bore sized to pass the free end of said flexible shackle;

means for mounting the receptor housing on a ski pole; and a second engaging member that selectively engages and disengages the receptor housing and defines a bore therein, alignable with the through-bore when the second engaging member engages the receptor housing.

12. The system of claim 11, further comprising:

means for mounting the second engaging member on a ski, wherein the receptor housing covers the means for mounting the second engaging member on a ski when the second engaging member engages the receptor housing.

13. The system of claim 11, wherein said means for mounting the receptor housing on a ski pole comprises a handgrip.

* * * * *